US005669443A

United States Patent [19]

Budde et al.

[11] Patent Number: 5,669,443

[45] Date of Patent: Sep. 23, 1997

[54] SHOE FOR USED IN THE CONSTRUCTION OF OIL AND GAS WELLS

[75] Inventors: Peter Budde, Vlaardingen; Guus Versteeg, Poortugaal, both of Netherlands

[73] Assignee: Weatherford /Lamb, Inc.

[21] Appl. No.: 586,370

[22] Filed: Jan. 16, 1996

[30] Foreign Application Priority Data

Sep. 4, 1995 [GB] United Kingdom ..... 9517975

[51] Int. Cl.[6] ..... E21B 17/05

[52] U.S. Cl. ..... 166/242.8; 166/242.6

[58] Field of Search ..... 166/242.8, 242.1, 166/242.6, 117.7, 327, 328, 329

[56] References Cited

U.S. PATENT DOCUMENTS

| | | | |
|---|---|---|---|
| 73,688 | 1/1868 | Arnold | 166/242.1 X |
| 1,811,885 | 6/1931 | Hill | 166/327 |
| 2,295,803 | 9/1942 | O'Leary . | |
| 2,635,697 | 4/1953 | Cannon . | |
| 3,012,608 | 12/1961 | McLaren, Jr. | 166/242.1 X |
| 3,266,577 | 8/1966 | Turner | 166/327 |
| 3,434,539 | 3/1969 | Merritt | 166/153 |
| 3,732,143 | 5/1973 | Joosse | 175/171 X |
| 4,175,619 | 11/1979 | Davis | 166/291 |
| 4,362,217 | 12/1982 | Fletcher | 175/402 |
| 5,520,252 | 5/1996 | McNair | 166/313 |

FOREIGN PATENT DOCUMENTS

| | | |
|---|---|---|
| A1 0323433 | 7/1989 | European Pat. Off. . |
| A 772663 | 11/1934 | France . |
| A1 2209038 | 6/1974 | France . |
| A1 3911467 | 10/1990 | Germany . |

OTHER PUBLICATIONS

Conventional and Specialized Float Equipment, Weatherford 1985.

Trico Industries, Inc., 1982—1983 Catalog p. 8232, 1982.

Joy Petroleum Equipment, Joy Mfg. Co., p. 4104, 1978.

Topco Industries Limited, Float Equipment, three pages, 1985.

Jani Int'l Inc., 1987–1988 Catalogue, pp. 98–99.

Davis–Lynch, Inc., 1984–85, pp. 5–7.

Bakerline Stage & Stable–In Cementing Equipment & Services, 1984, pp. 17–19.

Baker Oil Tools Primary Cementing, 1989, pp. 4–9.

*Primary Examiner*—Hoang C. Dang

*Attorney, Agent, or Firm*—Guy McClung

[57] ABSTRACT

A shoe for attachment to a length of casing for use in a wellbore comprises a body portion attachable to casing, and a nose portion rotatably mounted on the body portion. A casing string with a plurality of casing sections and such a shoe.

15 Claims, 2 Drawing Sheets

SHOE FOR USED IN THE CONSTRUCTION OF OIL AND GAS WELLS

FIELD OF THE INVENTION

This invention relates to a shoe for use in the construction of oil and gas wells and to a casing string provided with such a shoe.

BACKGROUND OF THE INVENTION

During the construction of oil and gas wells a wellbore is drilled into the ground. A casing string is then lowered down the wellbore and the annular space between the outside of the casing and the wellbore filled with cement.

Typically the bottom of the casing is fitted with either a guide shoe or a float shoe, the former having the function of helping prevent the end of the casing string being damaged as it is lowered down the well and the latter having the same function but also including a check valve for use in subsequent cementing operations.

At the present time the leading face of guide shoes and float shoes is generally spherical to facilitate the guidance of the casing string along the bore.

More recently there has been an increasing demand for bores which extend nearly horizontally from an existing vertical bore. Special techniques have been developed for drilling such bores. However, such bores undulate and have to be straightened out before the casing can be inserted. Thus, after the bore is drilled and the drill bit withdrawn, a special purpose tool is lowered down the casing on a work string to prepare the bore. The special purpose tool is then withdrawn and the casing lowered into position.

It will be appreciated that it takes a considerable time to lower the special purpose tool, prepare the bore and withdraw the special purpose tool and that a considerable financial saving could be made if this step could be avoided.

SUMMARY OF THE PRESENT INVENTION

According to the present invention there is provided a shoe for attachment to a length of casing, characterised in that said shoe comprises a body portion attachable to said casing, and a nose portion rotatably mounted on said body portion the arrangement being such that, in use, said nose portion can rotate relative to said body portion as said casing is introduced into a wellbore.

Preferably, said body portion and said nose portion are mounted on a pipe. If desired both said body portion and said nose portion may be rotatably mounted on said pipe. Preferably, however, one of said body portion and said nose portion is secured fast to said pipe and the other is rotatably mounted thereon.

Advantageously, said pipe extends through said body portion and said nose portion to allow fluid to flow between the interior of said casing and the interior of the wellbore.

Preferably, said body portion is provided with a hub section and said nose portion is provided with a recess which accommodates said hub section.

Advantageously, said nose portion is shaped to facilitate rotation of said nose portion when said nose portion encounters an obstruction as said arrangement is introduced into said wellbore.

In one particularly preferred embodiment the nose portion is wedge shaped and, advantageously, is provided with a rounded tip.

Preferably, the nose portion is provided with a rib to facilitate the rotation of said shoe if it encounters an obstruction.

The shoe may take the form of a simple guide shoe or a float shoe, i.e. a shoe provided with a check valve.

The present invention also provides a casing string provided with a shoe in accordance with the present invention.

BRIEF DESCRIPTION OF THE DRAWINGS

For a better understanding of the present invention reference will now be made, by way of example, to the accompanying drawing, in which.

DETAILED DESCRIPTION OF THE PREFERRED EMBODIMENT

Figure 1:
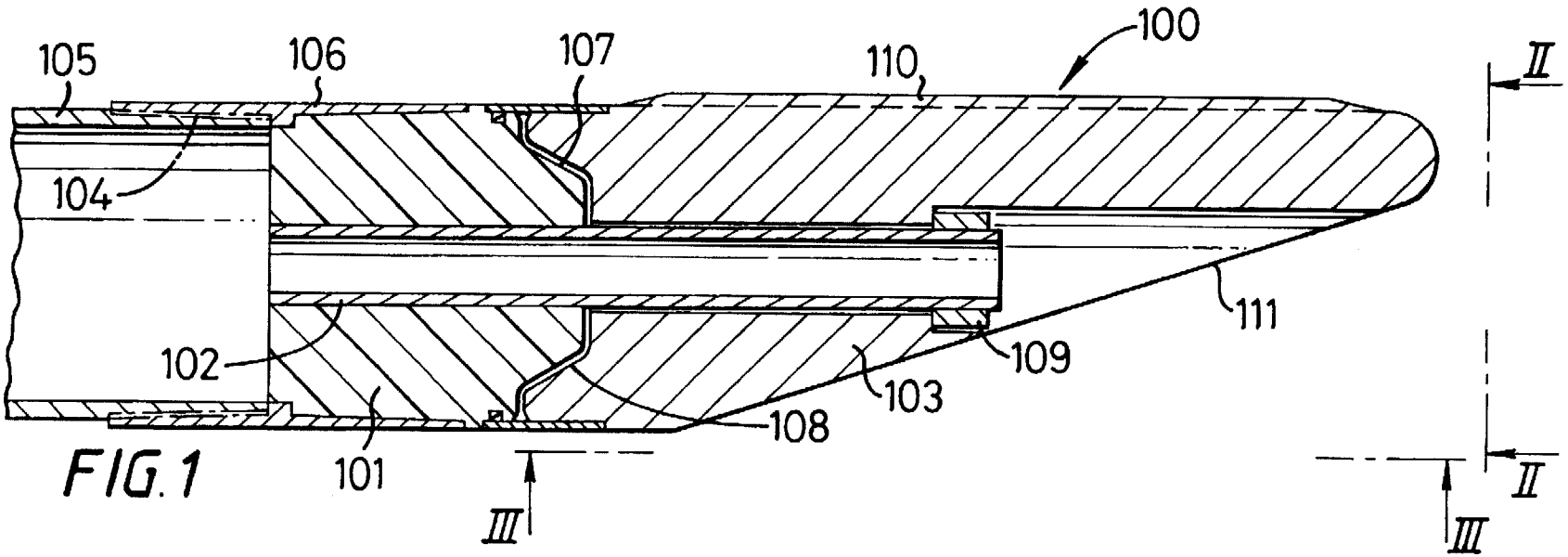
FIG. 1 is a section through a guide shoe in accordance with the present invention mounted on the end of a casing string.
Figure 3:
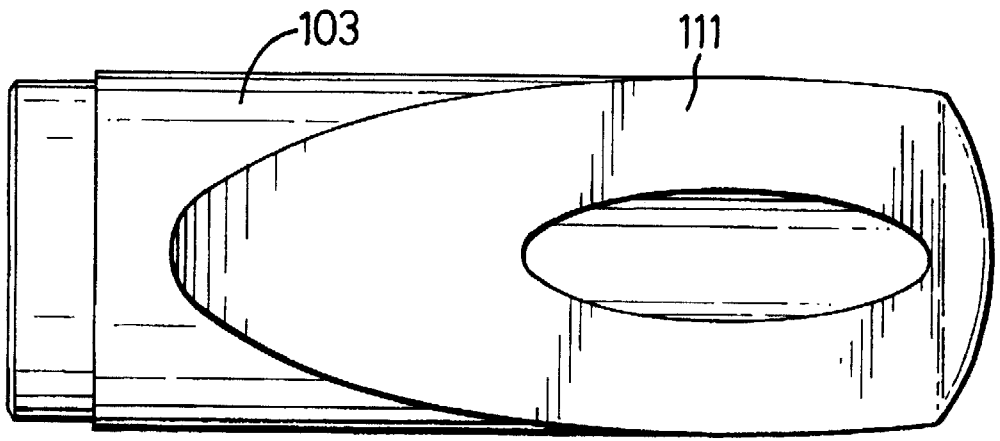
FIG. 3 is an underneath plan view looking in the direction of arrows III—III in FIG. 1.
Figure 2:
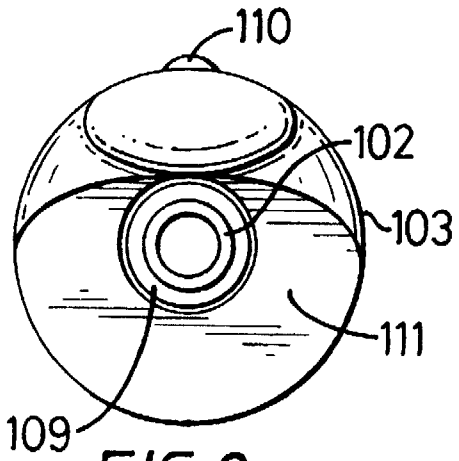
FIG. 2 is an end view looking in the direction of arrows II—II in FIG. 1.

Referring to the drawing, there is shown a guide shoe which is generally identified by the reference numeral 100.

The guide shoe 100 comprises a body portion 101 which is mounted fast on a pipe 102, and a nose portion 103 which is rotatably mounted on the pipe 102.

The body portion 101 is secured to the pin 104 on the end of a casing string 105 by means of a connector 106 which is bonded to the body portion 101 and threadedly connected to the pin 104.

The body portion 101 is provided with a hub section 107 which projects forwardly into a corresponding recess 108 in the rear of the nose portion 103.

The nose portion 103 is retained on the pipe 102 by a collar 109 which is glued to the pipe 102.

As can be seen from the figures, the nose portion 103 is wedge shaped with the leading edge of the wedge rounded off.

The top of the nose portion 103 is provided with a guide rib 110 as shown.

The nose portion 103 may conveniently be made of glass fibre reinforced plastics material and the body portion 101 of polyurethane. The pipe 102 is conveniently made from glass fibre reinforced epoxy.

In use, after a horizontal bore has been drilled the drill string is withdrawn. The guide shoe 100 is then mounted on the bottom of a casing string 105 which is lowered down the well. The casing then passes into the horizontal bore.

Figure 4:
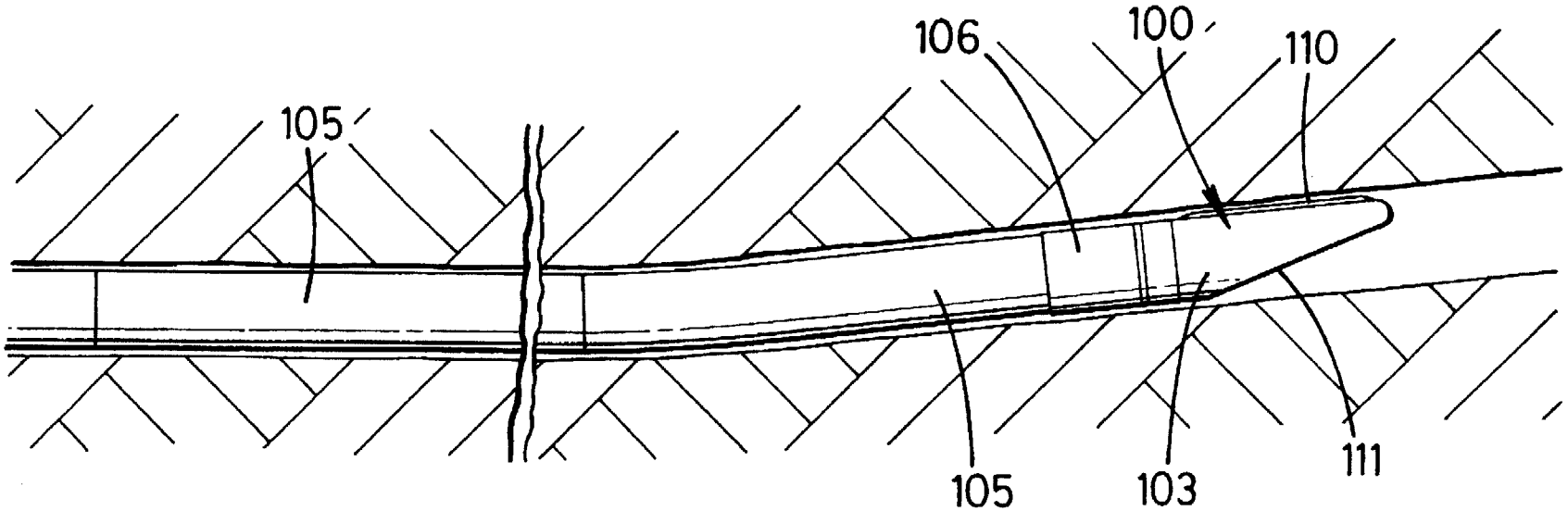
FIG. 4 is a schematic cross-section showing a casing provided with the guide shoe of FIG. 1 being inserted into a wellbore.

It will be appreciated that the horizontal bore is not entirely straight but undulates up and down and from side to side. As the casing moves along the horizontal bore the leading face 111 of the nose portion 103 rides over the bottom of the horizontal bore. If the bottom of the horizontal bore rises then the leading face 111 of the casing string 105 rises upwardly in much the same way as the bows of a speedboat guide the hull of a boat up the back of a wave as shown in FIG. 4.

If the tip of the nose portion 103 encounters an obstruction, for example caused by the bore deviating to one side or the other the nose portion 103 will rotate so that the leading face 111 rides over the obstruction. Thus, the nose portion 103 can assume any rotational position according to the direction of the deviation of the bore. If the tip of the nose portion 103 encounters an obstruction absolutely head on it is possible that the nose portion 103 will not rotate. Rib 110 reduces the risk of this occurring.

Various modifications may be made to the preferred embodiment described, for example the nose portion 103 and/or the body portion 101 and/or the pipe 102 could be made of any suitable material, for example a metal alloy such as an alloy of aluminium or zinc.

What is claimed is:

1. A shoe for attachment to a length of casing for use in a wellbore which shoe comprises a body portion attachable to said casing, and a nose portion which is rotatably mounted on said body portion and is shaped to facilitate rotation of said nose portion when said nose portion encounters an obstruction while said casing is being introduced into said wellbore, wherein said body portion and said nose portion are mounted on a pipe in and extending through said body portion and said nose portion to allow fluid to flow directly between the interior of said casing and the interior of the wellbore.

2. The shoe as claimed in claim 1, wherein one of said body portion and said nose portion is secured fast to said pipe and the other is rotatably mounted thereon.

3. The shoe as claimed in claim 1, wherein said body portion is provided with a hub section and said nose portion is provided with a recess which accommodates said hub section.

4. The shoe as claimed in claim 1, wherein the tip of the nose portion is rounded.

5. The shoe as claimed in claim 1, wherein said nose portion is provided with rib to facilitate the rotation of said nose portion when it encounters an obstruction.

6. A shoe for attachment to a length of casing for use in a wellbore which shoe comprises a body portion attachable to said casing, and a nose portion which is rotatably mounted on said body portion and is shaped to facilitate rotation of said nose portion when said nose portion encounters an obstruction while said casing is being introduced into said wellbore, wherein said body portion and said nose portion are mounted on a pipe, said pipe in and extending through said body portion and said nose portion to allow fluid to flow directly between the interior of the casing and the interior of the wellbore, and wherein said body portion is provided with a forwardly projecting hub section and said nose portion is provided with a recess which accommodates said hub section.

7. The shoe as claimed in claim 6, wherein one of said body portion and said nose portion is secured fast to said pipe and the other is rotatably mounted thereon.

8. The shoe as claimed in claim 6, wherein said nose portion is wedge shaped.

9. The shoe as claimed in claim 8, wherein the tip of the nose portion is rounded.

10. The shoe as claimed in claim 6, wherein said nose portion is provided with a rib to facilitate the rotation of said nose portion when it encounters an obstruction.

11. A shoe for attachment to a length of casing for use in a wellbore, which shoe comprises a body portion attachable to said casing, and a nose portion which is rotatably mounted on said body portion and rotatable relative to said body portion as said casing is introduced into a wellbore, wherein said nose portion is wedged shaped to facilitate rotation of said nose portion when said nose portion encounters an obstruction when said casing is introduced into said wellbore, and wherein the tip of the nose portion is rounded wherein said body portion and said nose portion are mounted on a pipe in and extending through said body portion and said nose portion to allow fluid to flow directly between the interior of said casing and the interior of the wellbore.

12. The shoe as claimed in claim 11, wherein one of said body portion and said nose portion is secured fast to said pipe and the other is rotatably mounted thereon.

13. The shoe as claimed in claim 11 wherein said body portion is provided with a hub section and said nose portion is provided with a recess which accommodates said hub section.

14. The shoe as claimed in claim 11, wherein said nose portion is provided with a rib to facilitate the rotation of said nose portion when it encounters an obstruction.

15. A casing string comprising a plurality of casing sections one secured to another, a shoe attached to a lowermost one of the sections of casing, said shoe comprising a body portion, and a nose portion which is rotatably mounted on said body portion and is shaped to facilitate rotation of said nose portion when said nose portion encounters an obstruction while said casing is being introduced into said wellbore, wherein said body portion and said nose portion are mounted on a pipe in and extending through said body portion and said nose portion to allow fluid to flow directly between the interior of said casing and the interior of the wellbore.

* * * * *